US006350399B1

(12) United States Patent
Cook et al.

(10) Patent No.: US 6,350,399 B1
(45) Date of Patent: Feb. 26, 2002

(54) METHOD OF FORMING A TREATED FIBER AND A TREATED FIBER FORMED THEREFROM

(75) Inventors: Michael Charles Cook, Marietta, GA (US); Debra Jean McDowall, Neenah, WI (US); Dana Elizabeth Stano, Lilburn; Michael David Powers, Canton, both of GA (US); Samuel Edward Marmon, Melbourne, FL (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/471,056

(22) Filed: Dec. 22, 1999

Related U.S. Application Data

(60) Provisional application No. 60/153,825, filed on Sep. 14, 1999.

(51) Int. Cl.[7] ..... D01D 5/08; D06M 23/00

(52) U.S. Cl. ..... 264/129; 264/176.1; 425/382.2; 425/464

(58) Field of Search ..... 264/129, 176.1; 425/382.2, 464

(56) References Cited

U.S. PATENT DOCUMENTS

| | | | |
|---|---|---|---|
| 874,287 | A | 12/1907 | Bayne et al. |
| 1,953,863 | A | 4/1934 | Morrell |
| 2,120,110 | A | 6/1938 | Morrell |
| 2,224,149 | A | 12/1940 | Fisher |
| 2,335,726 | A | 11/1943 | Averns et al. |
| 2,390,370 | A | 12/1945 | Hyde |
| 2,576,961 | A | 12/1951 | McCarthy |
| 2,708,813 | A | 5/1955 | Bourgeaux |
| 2,729,028 | A | 1/1956 | Slayter et al. |
| 2,756,718 | A | 7/1956 | Stone, Jr. et al. |
| 2,909,151 | A | 10/1959 | Kahn |
| 2,911,941 | A | 11/1959 | Sokal |
| 2,968,278 | A | 1/1961 | Wolfe |

(List continued on next page.)

FOREIGN PATENT DOCUMENTS

| | | |
|---|---|---|
| DE | 25 13 251 | 9/1976 |
| DE | 197 26 515 | 1/1998 |
| EP | 0 594 983 | 5/1994 |
| EP | 0 822 284 | 2/1998 |
| GB | 1 201 249 | 8/1970 |
| WO | 98/29246 | 7/1998 |

OTHER PUBLICATIONS

*Polymer Blands and Composites* by John A. Manson and Leslie H. Sperling, copyright 1976 by Plenum Press, a division of Plenum Publishing Corporation of New York, IBSN 0–306–30831–2, at pp. 273 through 277.

*Dictionary of Fiber & Textile Technology* by Hoechst Celanese, copyright 1990, pp. 59 and 94.

*Primary Examiner*—Leo B. Tentoni
(74) *Attorney, Agent, or Firm*—William D. Herrick

(57) ABSTRACT

The present disclosure is directed to a method of forming a treated fiber. A molten polymer is delivered to a fiber spinning assembly adapted to form and distribute polymer streams. At least one treatment is applied in a liquid state to at least one region on the surface of at least one molten polymer stream within the fiber spinning assembly. A substantial portion of the treatment remains on the surface of the resulting fiber within the treated region. One or more regions on the surface of the molten polymer may be treated with one or multiple treatments. The degree of coverage may vary from little coverage to complete coverage of the fiber surface. The treated regions may be in contact with one another or may be separate and distinct. A nonwoven web may be produced with selectively treated fiber regions by designing one or more fiber spinning assemblies to treat selected fibers or to apply multiple treatments. The regions of the nonwoven web may vary in treatment type, amount, or degree of coverage.

9 Claims, 6 Drawing Sheets

U.S. PATENT DOCUMENTS 2,972,370 A 2/1961 Walbolt
2,976,177 A 3/1961 Warthen
3,023,729 A 3/1962 Hayden et al.
3,032,813 A 5/1962 Stalego
3,073,136 A 1/1963 Dean
3,288,107 A 11/1966 Conrad
3,338,992 A 8/1967 Kinney
3,341,394 A 9/1967 Kinney
3,502,763 A 3/1970 Hartmann
3,508,892 A 4/1970 McCoppin
3,542,615 A 11/1970 Dobo et al.
3,562,369 A 2/1971 Chopra et al.
3,619,452 A 11/1971 Harrison et al.
3,684,416 A 8/1972 Lenk
3,692,618 A 9/1972 Dorschner et al.
3,709,970 A 1/1973 Hemker
3,775,150 A 11/1973 McClary
3,802,817 A 4/1974 Matsuki et al.
3,827,397 A 8/1974 Hebberling et al.
3,849,241 A 11/1974 Butin et al.
3,993,805 A 11/1976 Roberts
4,095,558 A 6/1978 Ellegast et al.
4,100,324 A 7/1978 Anderson et al.
4,109,610 A 8/1978 Parbhoo et al.
4,167,503 A 9/1979 Cipriani
4,192,252 A 3/1980 Paul
4,192,663 A 3/1980 Schmandt et al.
4,340,563 A 7/1982 Appel et al.
4,362,682 A 12/1982 Berg et al.
4,443,573 A 4/1984 Wells et al.
4,455,159 A 6/1984 Lamb et al.
4,457,034 A 7/1984 Simmen
4,469,499 A 9/1984 Lecron et al.
4,655,230 A 4/1987 Bryant et al.
4,741,949 A 5/1988 Morman et al.
4,795,668 A 1/1989 Krueger et al.
4,802,886 A 2/1989 Boocock
4,818,464 A 4/1989 Lau
4,857,251 A 8/1989 Nohr et al.
4,867,775 A 9/1989 Cain et al.
4,973,236 A 11/1990 Hasegawa et al.
5,057,262 A 10/1991 Nohr et al.
5,057,368 A 10/1991 Largman et al.
5,069,970 A 12/1991 Largman et al.
5,108,820 A 4/1992 Kaneko et al.
5,108,827 A 4/1992 Gessner
5,123,949 A 6/1992 Thiessen
5,151,321 A 9/1992 Reeves et al.
5,234,650 A 8/1993 Hagen et al.
5,244,614 A 9/1993 Hagen
5,277,976 A 1/1994 Hogle et al.
5,294,482 A 3/1994 Gessner
5,330,338 A 7/1994 Nakata et al.
5,336,552 A 8/1994 Strack et al.
5,382,400 A 1/1995 Pike et al.
5,466,410 A 11/1995 Hills
5,499,911 A 3/1996 Nakata et al.
5,516,476 A 5/1996 Haggard et al.
5,620,788 A 4/1997 Garavaglia et al.
5,632,944 A 5/1997 Blackwell
5,679,158 A 10/1997 Holzer, Jr. et al.
5,709,910 A 1/1998 Argyle et al.
5,744,089 A 4/1998 Woodside et al.
5,833,893 A 11/1998 Jones et al.
5,891,201 A 4/1999 Enderlin et al.
6,053,719 A 4/2000 Barbier et al.

METHOD OF FORMING A TREATED FIBER AND A TREATED FIBER FORMED THEREFROM

This application claims priority from U.S. Provisional Patent Application 60/153,825 filed Sep. 14, 1999.

FIELD OF THE INVENTION

The present invention relates to a treated fiber and a method of forming a treated fiber. Such treated fibers find many applications, for example, in nonwoven fabrics, yarns, carpets, and otherwise where fibers having one or more modified properties are desired.

BACKGROUND OF THE INVENTION

Nonwoven fabrics are finding increasing use in various applications, including personal care absorbent articles such as diapers, training pants, incontinence garments, mattress pads, wipers, and feminine care products (e.g., sanitary napkins), medical applications such as surgical drapes, gowns, wound care dressings, and facemasks, articles of clothing or portions thereof including industrial workwear and lab coats, household and industrial operations including liquid and air filtration, and the like.

It is often desirable to modify the properties of the nonwoven fabric to perform a function or meet a requirement for a particular application. One means of modifying the properties is through the use of treatments. Treatments are generally added by either topically treating the fibers or fiber web or by mixing the treatment with the polymer prior to forming fibers by melt extrusion or the like. Examples of typical types of treatments include, but are not limited to, stabilizers, delusterants, flame retardants, fillers, antimicrobial agents, optical brighteners, extenders, colorants, lubricants, antistatic agents, alcohol repellents, softeners, soil repellents, wetting agents, processing aids, and other functional chemistries.

Once an appropriate treatment is identified for an application, the means of applying the treatment to the fiber or fiber web often presents challenges. Some treatments may be applied either internally or topically, depending on the chemical structure of the treatment and any process limitations.

Topical treatment, or coating, of a formed fiber or fiber web may be accomplished by various techniques, including foam treating as disclosed in U.S. Pat. No. 4,095,558 (Ellegast et al.), roll coating as disclosed in U.S. Pat. No. 3,993,805 (Roberts), spray coating as disclosed in U.S. Pat. No. 3,032,813 (Stalego), slot coating as disclosed in U.S. Pat. No. 4,457,034 (Simmen) and U.S. Pat. No. 5,679,158 (Holzer, Jr. et al.), brush treating as disclosed in European Patent No. 0 594 983 A1 (Garavaglia et al.), and dip and squeeze treating, which consists of submerging the fiber in a treatment bath followed by blotting or squeezing to remove the excess, as disclosed in U.S. Pat. No. 5,151,321 (Reeves et al.). When only a low level of treatment is required, such systems may result in poor treatment uniformity on the fiber or fiber web surface. As a result, it is often necessary to increase the treatment level or dilute the treatment to form a treatment bath. The treatment process may then be followed by a costly and/or cumbersome drying step that may adversely impact the physical properties, such as strength, of the fiber or fiber web. Further, the application of multiple immiscible treatments may require a multi-step coating and drying process.

Traditionally, internal treatment has been achieved by compounding a treatment into a polymer and blending the compounded product with untreated polymer pellets prior to extrusion as disclosed in U.S. Pat. No. 4,167,503 (Cipriani), or by directly combining the treatment with the molten polymer during extrusion as disclosed in U.S. Pat. Nos. 4,857,251 and 5,057,262 (Nohr et al.). Such processes require extensive mixing to attain uniformity of the treatment in the fiber and lengthy purge times to remove the treatment from the extruder during typical manufacturing process changes.

An alternative approach, exemplified by U.S. Pat. No. 5,516,476 (Haggard et al.), blends the treatment with the molten polymer by passage through mixer channels in the spin pack plates immediately upstream of the spinning orifices of a spinneret. This approach shortens the purge time but does not use all treatments efficiently, as many treatments are functional only on the fiber surface and provide little or no benefit when in the interior of the fiber. Treatments that are not miscible with the polymer may migrate to the fiber surface over time, but even highly migratory treatments may not diffuse to the surface completely. As a result, higher treatment levels are often required to achieve the desired fiber properties. As with the topical treatment systems, internal treatment systems may be limited to use of a single treatment or blends of miscible treatments, since the incorporation of multiple immiscible treatments may result in fiber formation difficulties and poor treatment uniformity on the surface of the fiber.

Thus, traditional topical treatment systems are limited in terms of uniformity, cost, and flexibility, but are useful for applying the treatment only to the surface of a fiber or fiber web where its functional benefit is often desired. Internal treatment systems may simplify the treatment process, but are often inefficient due to long polymer purge times or increased treatment level requirements to obtain the desired properties on the surface of the fiber. Thus, a system that offers the benefits of both topical treatment and internal treatment is highly desirable.

The prior art has not presented a method nor an apparatus for selectively applying one or more treatments to the surface of an advancing molten polymer without mixing with the polymer. Such a process would allow for rapid product changes, highly efficient use of treatment and polymer, the use of multiple immiscible treatments, minimal drying requirements, if any, and reduced processing interruptions.

SUMMARY OF THE INVENTION

The present invention provides a treated fiber and a method of forming a treated fiber. A molten polymer is delivered to a fiber spinning assembly adapted to form and distribute a polymer stream. At least one treatment is applied in a liquid state to at least one region on the surface of the molten polymer stream within the fiber spinning assembly. A substantial portion of the treatment remains on the surface of the formed fiber within the region to which the treatment was applied.

Any polymer that is suitable for a fiber formation process may be used to form a treated fiber of the present invention. Similarly, any type of treatment may be used, for example, wetting agents, skin care treatments, medicinal treatments, and antistatic agents, provided that the treatment is able to withstand the processing conditions used during fiber formation processes and does not adversely impact fiber formation. The level of treatment may range from about 0.05% to about 3.0% by weight of the fiber, for example, and preferably ranges from about 0.1% to about 1.5% by weight of the fiber. The treatment is preferably a liquid or in a form which can be transported in a liquid carrier, i.e, in a liquid state.

In one embodiment, one or more regions on the surface of the molten polymer are treated with a single treatment or blend of multiple treatments. The region may be circumferential, i.e., in a direction around the fiber, or longitudinal, i.e., in a direction along the length of the fiber. The region may be continuous or discontinuous. The degree of coverage may vary from little coverage to complete coverage of the fiber surface, depending on the requirements for the particular application.

In another embodiment, two or more treatments are applied to multiple regions on the surface of the fiber. The regions may be in contact with one another or may be separate and distinct. The treatments may be miscible or immiscible.

In still another embodiment, a nonwoven web is produced with selectively treated fiber regions. This is accomplished through design of one or multiple fiber spinning assemblies to treat selected fibers or to apply multiple treatments. The regions of the fibers in the nonwoven web may vary in treatment type, amount, or degree of coverage.

The method of forming a treated fiber and the treated fiber of the present invention can be used to make nonwoven fabrics for a variety of applications. The broad scope of the applicability of the present invention will become apparent to those of skill in the art from the details given hereafter. However, it should be understood that the detailed description of the preferred embodiments of the present invention is given only by way of illustration because various changes and modifications well within the spirit and scope of the invention should become apparent to those of skill in the art in view of the following detailed description.

DEFINITIONS

Figure 1:
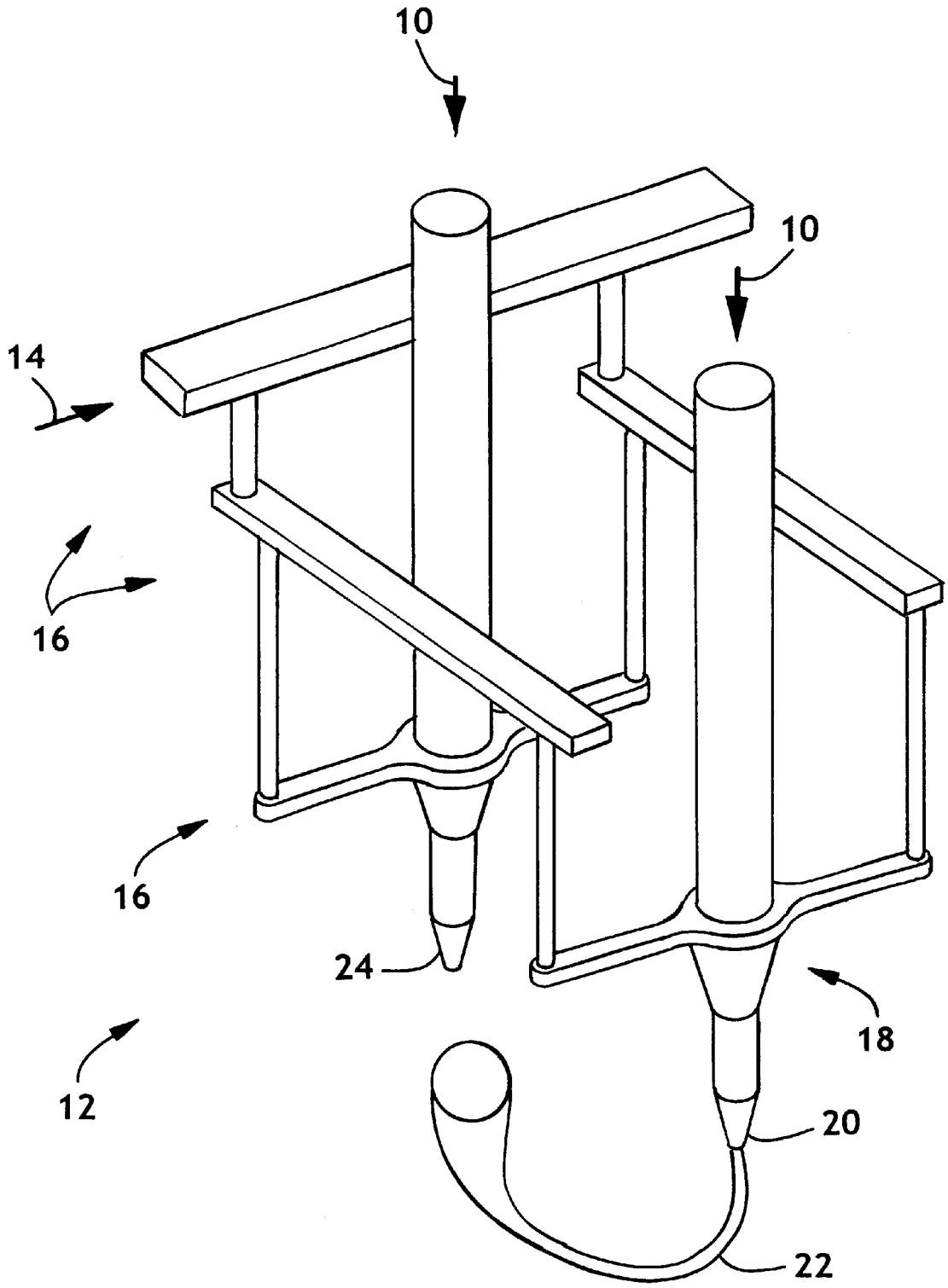
FIG. 1 is an exemplary method of forming a treated fiber according to the present invention.
Figure 2A:
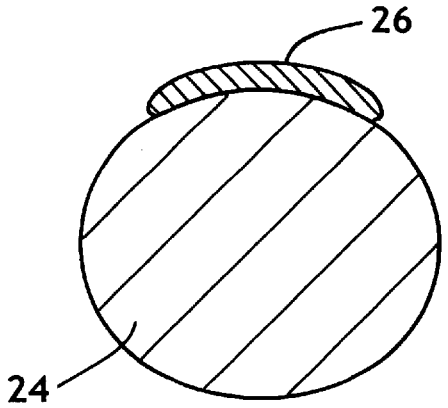
FIGS. 2(*a*)–2(*d*) are fiber cross-sections with various treatment configurations according to the present invention.
Figure 2B:
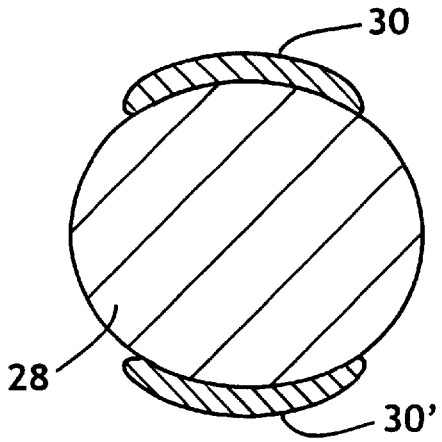
Figure 2C:
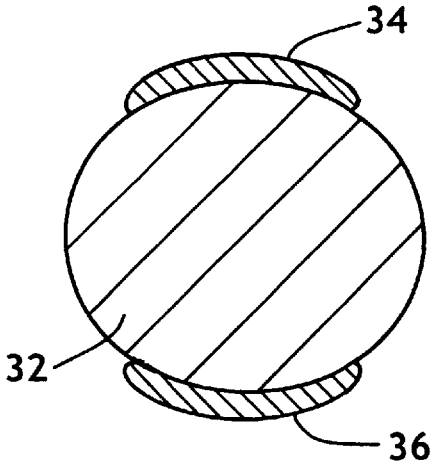
Figure 2D:
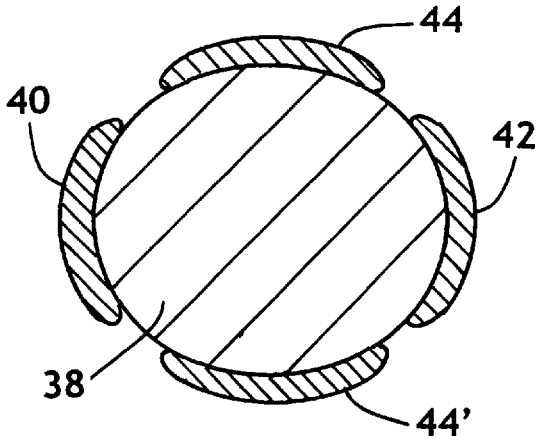

As used herein, "treatment" refers to any substance used to modify the physical or chemical properties of a fiber or fiber web. A treatment may be a single substance or a blend of two or more substances. As used herein, "internal treatment" refers to any treatment that is substantially mixed with a molten polymer at any stage during a fiber forming process. As used herein, the term "topical treatment" refers to any treatment that is applied externally to a fiber or fiber web.

As used herein the term "blend" means a mixture of two or more polymers or treatments. "Miscible" and "immiscible" describe a blend having a negative and positive value, respectively, for the free energy of mixing. As used herein, a "liquid" is any predominantly nonparticulate, nongaseous substance which can assume the shape of a container. As used herein, the term "liquid state" describes a substance having the properties of a liquid, including, for example, slurries, suspensions, emulsions, and the like.

As used herein, the term "fiber" refers to the basic element of fabrics and other textile structures. A fiber is characterized by having a length as formed of at least about 100 times its width or diameter. A fiber may be made of a natural polymer, e.g., alginic or cellulose-based fibers, a synthetic polymer, e.g., polyester, polypropylene, polyethylene, polyurethane, and polyvinyl fibers, or a mineral, e.g., glass. Such fibers are discussed in the *Dictionary of Fiber & Textile Technology* by Hoechst Celanese, copyright 1990 at pages 59 and 94.

As used herein, the term "nonwoven fabric" or "web" or "fiber web" means a web having a structure of individual fibers or threads which are interlaid, but not in an identifiable manner as in a knitted fabric. As used, herein, the term "web" or "layer" when used in the singular can have the dual meaning of a single element or a plurality of elements. The basis weight of a nonwoven fabric is usually expressed in ounces of material per square yard (osy) or grams per square meter (gsm) and the fiber diameter is usually expressed in microns. (Note that to convert from osy to gsm, multiply osy by 33.91). Another frequently used expression of fiber diameter is "denier", which is defined as grams per 9000 meters of a fiber and may be calculated as fiber diameter in microns ($\mu$m) squared, multiplied by the density in grams/cc, multiplied by 0.00707. A lower denier indicates a finer fiber and a higher denier indicates a thicker or heavier fiber. For example, the diameter of a polypropylene fiber given as 15 microns ($\mu$m) may be converted to denier by squaring, multiplying the result by 0.89 g/cc and multiplying by 0.00707. Thus, a 15 micron ($\mu$m) polypropylene fiber has a denier of about $1.42(15^2 \times 0.89 \times 0.00707 = 1.415)$. Outside the United States the unit of measurement is more commonly the "tex", which is defined as the grams per kilometer of fiber. Tex may be calculated as denier/9.

As used herein the term "spunbond fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al. The contents of each of the foregoing patents are incorporated herein by reference in their entirety. Spunbond fibers are generally not tacky when they are deposited onto a collecting surface. Spunbond fibers are generally continuous and have average diameters (from a sample of at least 10) larger than 7 microns ($\mu$m), often between about 10 and 20 microns ($\mu$m).

As used herein, the term "coform" means a process in which at least one meltblown diehead is arranged near a chute through which other materials are added to the fibers web while forming the web. Such other materials may be pulp, superabsorbent particles, cellulose or staple fibers, for example. Coform processes are shown in commonly assigned U.S. Pat. No. 4,818,464 to Lau and U.S. Pat. No. 4,100,324 to Anderson et al, the entire contents of which are incorporated herein in their entirety. Webs produced by the coform process are generally referred to as coform materials.

As used herein the term "meltblown fibers" means fibers formed by extruding a molten thermoplastic material through a plurality of fine, usually circular, die capillaries as molten threads or filaments into converging high velocity, usually hot, gas (e.g., air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin et al, incorporated herein in its entirety. Meltblown fibers, which may be continuous or discontinuous, are generally smaller than 10 microns in average diameter and are often tacky when deposited onto a collecting surface.

As used herein the term "microfibers" means small diameter fibers having an average diameter not greater than about 25 microns ($\mu$m), for example, having an average diameter of from about 0.5 microns ($\mu$m) to about 20 microns ($\mu$m), or more particularly, microfibers may have an average diameter of from about 2 microns ($\mu$m) to about 10 microns ($\mu$m).

As used herein the term "monocomponent fibers" refer to fibers formed from one or more extruders using only one polymer. This is not meant to exclude fibers formed from one polymer to which small amounts of additives have been added for colors, anti-static properties, lubrication, hydrophilicity, etc. These additives, e.g., titanium dioxide for colors, are normally present in an amount less than 5 weight percent and more typically about 2 weight percent.

As used herein the term "conjugate fibers" refers to fibers which have been formed from at least two polymers extruded from separate extruders but spun together to form one fiber. Conjugate fibers are also sometimes referred to as "multicomponent fibers" or "bicomponent fibers". The polymers are usually different from each other though conjugate fibers may be monocomponent fibers. The polymers are arranged in substantially constantly positioned distinct zones across the cross-section of the conjugate fibers and extend continuously along the length of the conjugate fibers. The configuration of such a conjugate fiber may be, for example, a sheath/core arrangement wherein one polymer is surrounded by another or may be a side by side arrangement, a pie arrangement or an "islands-in-the-sea" arrangement. Conjugate fibers are taught in U.S. Pat. No. 5,108,820 to Kaneko et al., U.S. Pat. No. 4,795,668 to Krueger et al., and U.S. Pat. No. 5,336,552 to Strack et al. Conjugate fibers are also taught in U.S. Pat. No. 382,400 to Pike et al. and may be used to produce crimp in the fibers by using the differential rates of expansion and contraction of the two (or more) polymers. Crimped fibers may also be produced by mechanical means and by the process of German Patent DT 25 13 251 A1. For two component fibers, the polymers may be present in ratios of 75/25, 50/50, 25/75 or any other desired ratios. The fibers may also have shapes such as those described in U.S. Pat. No. 5,277,976 to Hogle et al., U.S. Pat. No. 5,466,410 to Hills, and U.S. Pat. Nos. 5,069,970 and 5,057,368 to Largman et al., which describe fibers with unconventional shapes.

As used herein the term "biconstituent fibers" refers to fibers which have been formed from at least two polymers extruded from the same extruder as a blend. Biconstituent fibers do not have the various polymer components arranged in relatively constantly positioned distinct zones across the cross-sectional area of the fiber and the various polymers are usually not continuous along the entire length of the fiber, instead usually forming fibrils or protofibrils which start and end at random. Biconstituent fibers are sometimes also referred to as "multiconstituent fibers". Fibers of this general type are discussed in, for example, U.S. Pat. Nos. 5,108,827 and 5,294,482 to Gessner. Bicomponent and biconstituent fibers are also discussed in the textbook *Polymer Blends and Composites* by John A. Manson and Leslie H. Sperling, copyright 1976 by Plenum Press, a division of Plenum Publishing Corporation of New York, IBSN 0-306-30831-2, at pages 273 through 277.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

As used herein and in the claims, the term "comprising" is inclusive or open-ended and does not exclude additional unrecited elements, compositional components, or method steps.

DETAILED DESCRIPTION OF THE INVENTION

Referring to FIG. 1, a molten polymer 10 is delivered to a fiber spinning assembly 12, which generally contains a series of thin distribution plates (not shown) having channels for distribution and holes for passage therethrough. A stream of treatment 14 is brought into the fiber spinning assembly and is delivered to the perimeter of the holes via conduit 16. The channels and holes used to deliver the polymer are separate from those used for the treatment, so there is no mixing of the treatment and the molten polymer. At a point prior to where the polymer stream enters the final plate 18, known as the spinneret plate, the treatment is contacted with the molten polymer such that the treatment is applied to one or more regions on the surface of the molten polymer stream. The treated polymer then passes through an orifice 20 in the spinneret plate and a treated fiber 22 is formed. A similar fiber would be formed upon passage through orifice 24 in the spinneret plate, but is not illustrated for the purpose of clarity. A substantial portion of the treatment remains on the surface of the fiber within the treated region, resulting in a more efficient use of treatment as compared with traditional topical or internal treatment methods.

The fiber may then be collected or combined with other fibers to form a nonwoven web, yarn, or the like. If desired, the fiber spinning assembly may be designed to apply the treatment only to fibers in certain region or layers of the resulting nonwoven web, or to create regions on the nonwoven web with varying degrees or types of treated fibers. Examples of such nonwoven web processes that may be useful in the present invention include meltblowing processes, spunbonding processes, coforming processes and bonded carded web processes. Other useful processes will be apparent to those skilled in the art.

The nonwoven web formed from fibers of the present invention may be a mixture of various types of fibers with or without particulates. For an example of such a mixture, reference is made to a process in which elastomeric and non-elastomeric fibers are commingled to form a single coherent web of randomly dispersed fibers. Another example of such a web would be one made by a technique such as disclosed in U.S. Pat. No. 4,741,949 to Morman et al, which discloses a nonwoven material which includes a mixture of meltblown thermoplastic fibers and other materials. The fibers and other materials are combined in the gas stream in which the meltblown fibers are bome so that an intimate entangled commingling of meltblown fibers and other materials occurs prior to collection of the fibers upon a collecting device to form a coherent web of randomly dispersed fibers. Examples of some particulates that may be used include, but are not limited to, wood pulp, staple fibers or particulates, such as activated charcoal, clays, starches, or hydrocolloid (hydrogel) particulates commonly referred to as super-absorbent materials.

The fiber of the present invention may be formed from any suitable thermoplastic polymer or blend containing the same, and may be monocomponent, conjugate, or biconstituent. Useful polymers include polyolefins, for example, polyethylene, polypropylene and polybutene, ethylene copolymers, propylene copolymers and butene copolymers, high density polyethylene, low density polyethylene, and linear low density polyethylene. Other suitable thermoplastic polymers include cellophane, polyvinyl acetate, polyvinyl alcohol, polycaprolactam, polyester, polyamide, polyethylene terephthalate, polybutylene terephthalate, polytetrafluoroethylene, or mixtures or coextrusions of one or more of these materials.

The fiber of the present invention may also be formed from an elastomeric thermoplastic polymer such as a block copolymer including polyurethanes; copolyester elastomers like copolyetheresters; polyamide polyether block copolymers; copolymers of ethylene and at least one vinyl monomer, for example, vinyl acetates such as ethylene vinyl acetate (EVA), unsaturated aliphatic monocarboxylic acids, and esters of such monocarboxylic acids; block copolymers having the general formula A-B-A', A-B or A-B-A-B like copoly(styrene/ethylene-butylene), styrene-poly(ethylene-propylene)-styrene, styrene-poly(ethylene-butylene)-styrene, (polystyrene/poly(ethylene-butylene)/polystyrene, poly(styrene/ethylene-butylene/styrene), polystyrene-poly(ethylene-propylene)-polystyrene-poly(ethylene-propylene) and the like. Also, the new class of polymers referred to as single site catalyzed polymers such as "metallocene" polymers produced according to a metallocene process are also useful. For a more detailed description of the metallocene polymers and the process for producing the same which are useful in the present invention see commonly assigned PCT Patent Application No. WO 98/29246 to Gwaltney et al., which is incorporated herein by reference in its entirety.

The method of the present invention offers a high degree of flexibility in forming a treated fiber. The treatment configurations that may be formed are limited only by the ability to construct spinning plates with sufficiently sized holes and by the ability to accurately meter a particular treatment level to the fiber spinning assembly. The thickness and degree of coverage of the treatment on the surface of the fiber is determined by the flow rate of treatment metered to the fiber spinning assembly and the dimensions of the contact area between the treatment and the advancing molten polymer stream. The level of treatment may range, for example, from about 0.05% to about 3.0% by weight of the fiber, and preferably ranges from about 0.1% to about 1.5% by weight of the fiber. The treatment is preferably a liquid or in a form which can be transported in a liquid carrier, i.e, in a liquid state.

Figure 3A:
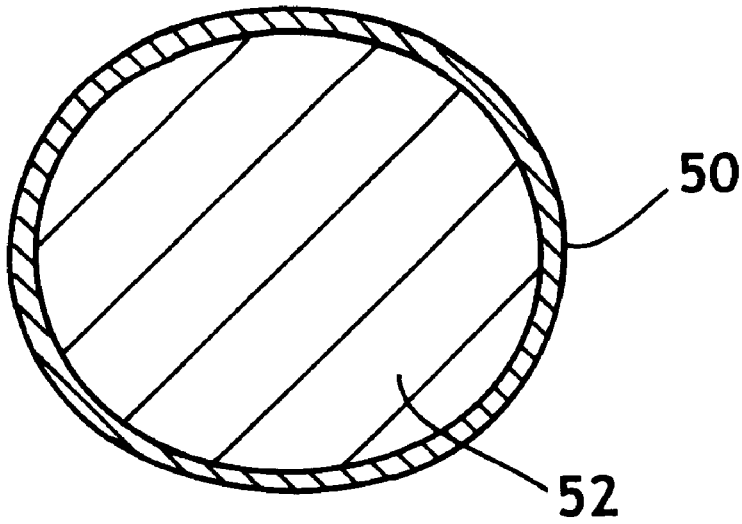
FIGS. 3(*a*) and 3(*b*) are fiber cross-sections with circumferentially continuous and circumferentially discontinuous treatment regions, respectively.
Figure 3B:
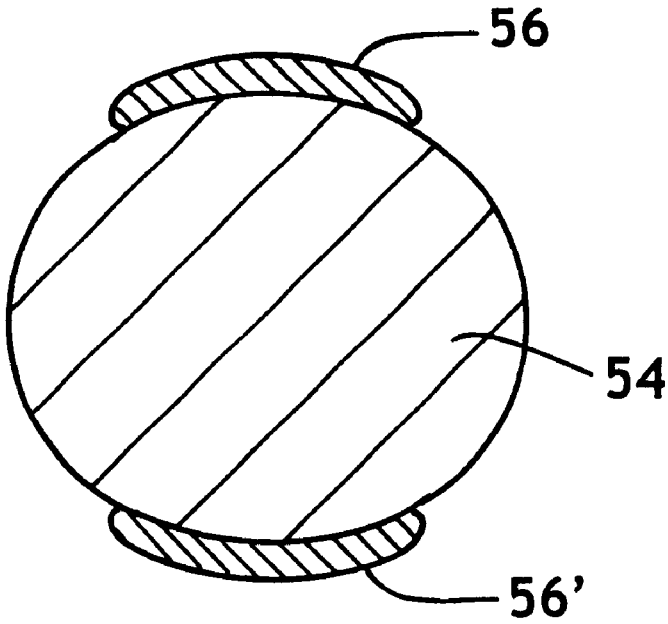
Figure 4A:
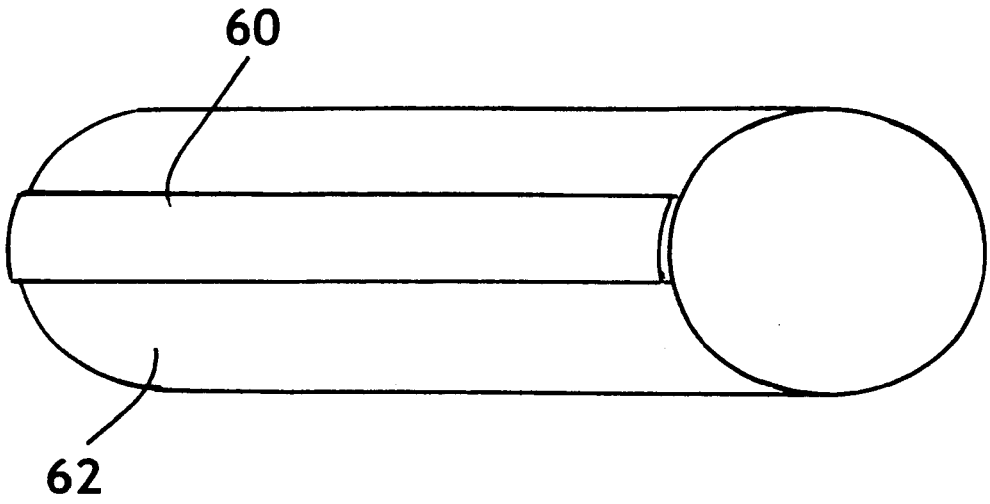
FIGS. 4(*a*) and 4(*b*) are side views of a fiber with a longitudinally continuous treatment region and a longitudinally discontinuous treatment region, respectively.
Figure 4B:
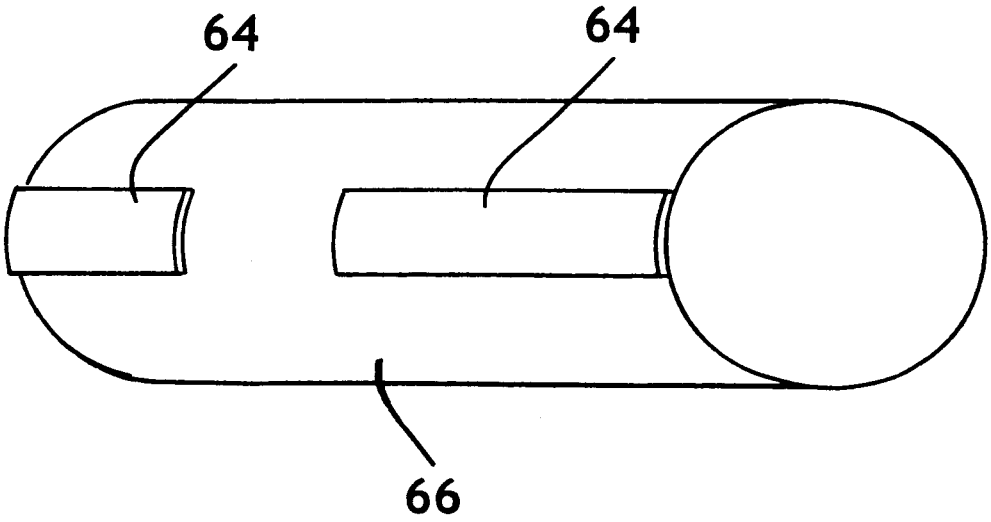

FIGS. 2(*a*)–2(*d*) generally exemplify some potential fiber treatment configurations. For the purpose of clarity, the illustrations included herein are not drawn to scale. FIG. 2(*a*) generally shows a cross-section of a fiber 24 having a single treatment region 26, in which the treatment may be one treatment or a blend of two or more treatments. FIG. 2(*b*) generally shows a cross-section of a fiber 28 having a two treatment regions 30 and 30' with a single treatment. FIG. 2(*c*) generally shows a cross-section of a fiber 32 having two treatment regions 34 and 36 with two different treatments. FIG. 2(*d*) generally shows a cross-section of a fiber 38 with multiple treatment regions 40, 42, 44, and 44' and multiple treatments. The treated region 50 may be continuous around the circumference of a fiber 52 (FIG. 3(*a*)) or may consist of multiple, generally separate and distinct regions 56 and 56' on the surface of a fiber 54 (FIG. 3(*b*)). The treated region 60 on the surface of a fiber 62 may be generally continuous in a longitudinal dimension, i.e., along the length of a fiber, as in FIG. 4(*a*), or the treated regions 64 on the surface of a fiber 66 may be generally discontinuous in a longitudinal dimension as in FIG. 4(*b*).

In general, any treatment that is able to maintain a liquid state at the temperature reached in the fiber forming process and which does not adversely affect the ability to form a fiber may be used to impart a property to the resulting fiber or nonwoven web. Typical fiber forming process temperatures for polyolefin thermoplastics, for example, range from about 300° F. (149° C.) to about 550° F. (288° C.). The treatment is preferably beneficial on the exterior surface of the fiber and sufficiently compatible with the polymer so that it does not have a tendency to bead up and drip off the fiber or evaporate from the surface of the fiber. Examples of such possible treatments include, but are not limited to, stabilizers, delusterants, flame retardants, fillers, antimicrobial agents, optical brighteners, extenders, colorants, lubricants, antistatic agents, alcohol repellents, softeners, soil repellents, wetting agents, processing aids, and other functional chemistries.

Some treatments may be selected for their ability to spread across the surface of a fiber. A highly mobile treatment, for example, a silicone polyether wetting agent, applied to narrow regions on the molten polymer stream will spread across the surface of the fiber over time. Thus, a low level of a highly mobile treatment may be applied in, for example, a dual treatment region configuration to form a treated fiber with a very thin layer of treatment and a high degree of coverage. Therefore, less treatment is needed to form a very thin layer of treatment on the entire surface of the fiber than would be required using a traditional internal treatment process. Further, uniformity is improved over that which may be obtained using a traditional topical treatment method.

With some treatments, however, it may be undesirable to obtain a high degree of coverage of the surface of the fiber. For example, in medical applications, such as surgical drapes and garments, it is necessary to obtain high liquid barrier properties in addition to electrical conductivity. The use of an alcohol repellent (e.g., fluorochemical) and an antistatic agent (e.g., alkyl phosphate ester) may be appropriate for such an application. A disadvantage of many antistatic agents is that such treatments are also wetting agents; thus, using certain antistatic agents may compromise the barrier properties of the nonwoven fabric or garment. With the present invention, however, a low level of an antistatic agent may be applied to a narrow and discrete region on the fiber while a higher level of an alcohol repellent treatment may be applied to a second discrete region on the fiber, creating a conductive path needed for electrical conductivity without substantially inhibiting the barrier properties of the nonwoven fabric or garment.

Figure 5:
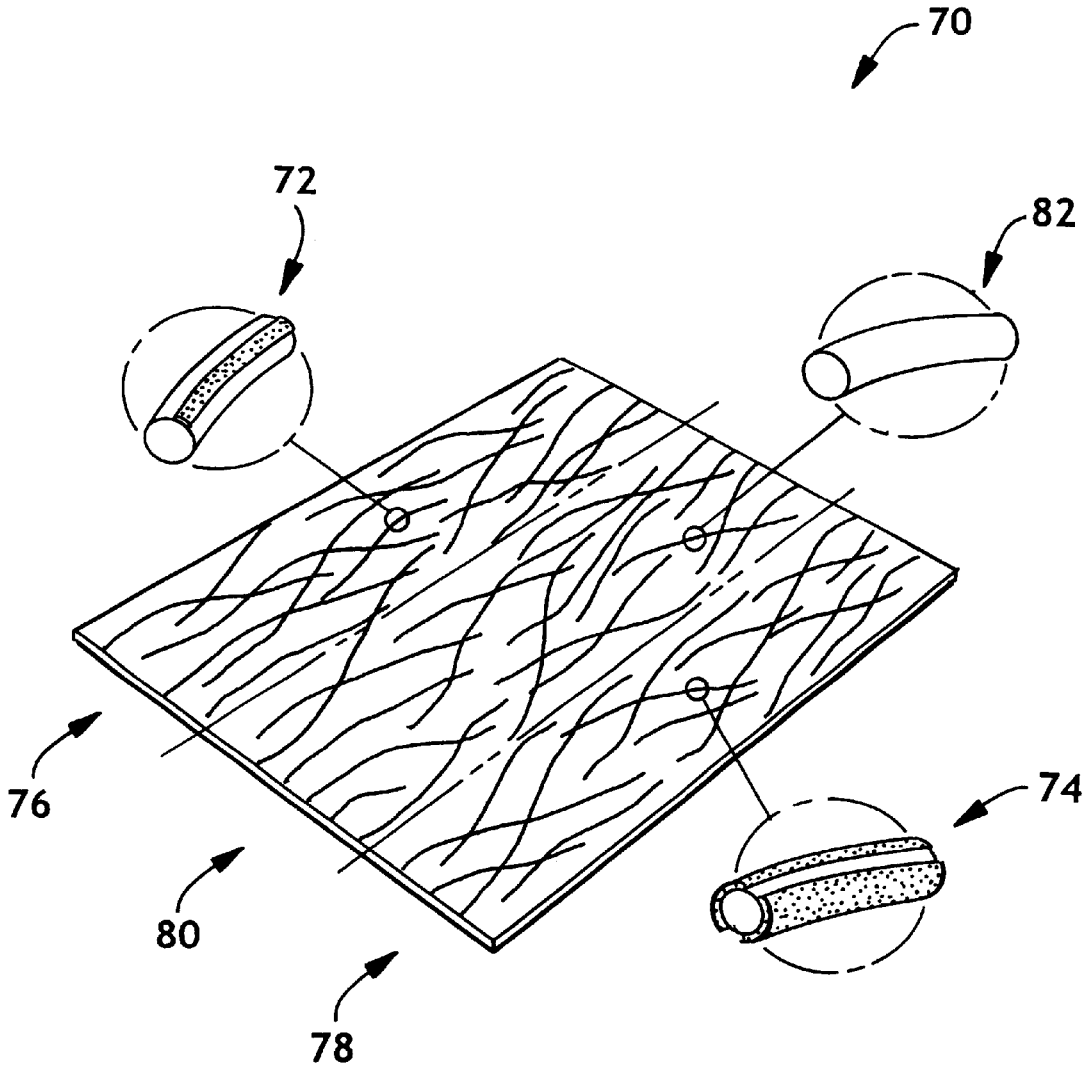
FIG. 5 is an exemplary nonwoven web with multiple treatment regions which may be made according to the present invention.

The method of the present invention may also be used to produce fibers of nonwoven web with similar flexibility in overall treatment configuration and coverage. FIG. 5 generally shows a nonwoven web 70 with treated fibers 72

(single treatment region) and 74 (two treatment regions) in selected areas 76 and 78, respectively, made according to the present invention, and an area 80 of the nonwoven in which the fibers 82 are not treated. Examples of applications in which such nonwoven webs may find use include, but are not limited to, personal care articles, in which it may be desirable to have one or more regions treated with a wetting agent for liquid permeability, wound care dressings, in which it may be desirable to have one or more regions treated with medicinal treatments (e.g., antibacterial agent) or other skin care treatments (e.g., aloe), and in medical fabrics (e.g., surgical drapes or garments), in which it may be desirable to have one or more regions with differing degrees or types of treatment to alter the coefficient of friction or antistatic properties.

Figure 6:
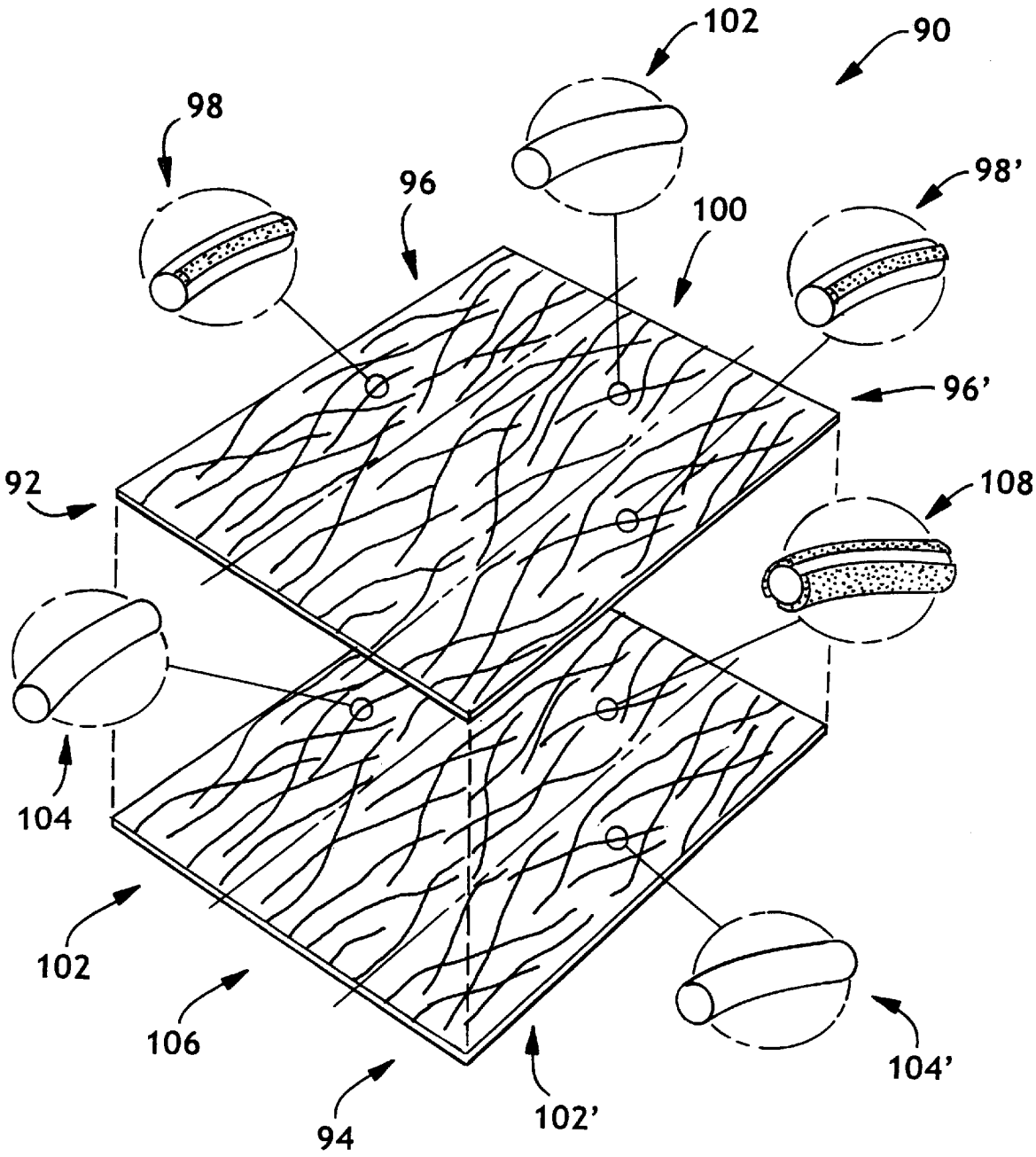
FIG. 6 is an exemplary nonwoven web with multiple treatment layers which may be made according to the present invention.

FIG. 6 generally depicts a nonwoven web 90 in which layers 92 and 94 of the nonwoven web have different treatment types and/or configurations. The top layer 92 has two sections 96 and 96' in which the fibers 98 and 98' are treated in a single treatment region on the fiber and a center area 100 in which each fiber 102 is not treated. The bottom layer 94 has two sections 102 and 102' in which the fibers 104 and 104' are not treated and a center area 106 in which each fiber 108 is treated in two treatment regions. Examples of applications in which such a nonwoven web may find use include, but are not limited to, personal care articles, in which varying levels of wetting agents may be applied to two or more layers to create a surface energy gradient for enhanced liquid permeability or in which it may be desirable to have a layer treated with a skin care treatment (e.g., aloe) or medicinal treatment (e.g., antibacterial agent) and an additional layer that is hydrophilic, and medical garments, for example surgical gowns, in which it may be desirable to have a surface that is blood and/or alcohol repellent and an additional layer that is antistatic.

The present invention is further described with the following example and comparative example which are provided to demonstrate the advantages of the present invention. The example is presented solely for purposes of illustration and should not be construed as limiting the invention. It should be understood by those skilled in the art that the parameters of the present invention will vary somewhat from those provided in the following Example depending on the particular processing equipment that is used. It is intended to include within the invention as defined by the claims all alternatives, modifications, and equivalents to those elements that are specifically described.

EXAMPLE

Polypropylene spunbond nonwoven fabric samples were prepared on 14 in. (35.6 cm) wide pilot equipment using a fiber forming process similar to that disclosed in U.S. Pat. No. 3,802,817 (Matsuki et al.) to demonstrate the improved efficiency and performance of the present invention. A hydrocarbon-based wetting agent, Atmer 688 available from ICI Surfactants, Inc. in Wilmington, DE, was selected as the treatment for its ability to withstand processing temperatures of about 430° F. (221° C.).

After the molten polymer passed through the fiber spinning assembly, the fibers were laid on a moving wire and thermally point bonded to form a nonwoven web. The resulting nonwoven material had a basis weight of about 1.35 osy (45.8 gsm) and a denier of about 2.5. The samples were evaluated for water wettability by placing the sample on a flat surface and using a disposable pipette to place a few drops of distilled water on the sample. In general, a highly wettable substrate will allow drops of water to instantaneously wet the fibers and pass through the nonwoven. The results of the evaluation are summarized in Table 1.

Samples 1 and 2 were produced according to the present invention using a positive-displacement pump to precisely meter the treatment under high pressure to the fiber spinning assembly through a heated supply line. The treatment was then metered to individual holes using a series of thin distribution plates. Treatment levels of about 0.25% and about 0.50% by weight of the fiber were applied to individual molten polymer streams using a continuous dual treatment region configuration to produce Samples 1 and 2, respectively. Upon contact with water, the resulting nonwoven webs exhibited instantaneous wettability.

Samples 3 and 4 were produced according to traditional internal treatment methods by blending the treatment with the molten polymer at levels of about 1% and about 2% by weight, respectively, of the fiber. The treatment and the molten polymer were thoroughly mixed prior to entering the fiber spinning assembly. When the resulting nonwoven webs were contacted with water, neither Sample 3 nor Sample 4 exhibited any degree of wettability.

TABLE 1

| Sample | Treatment Level | Result |
|---|---|---|
| 1 | 0.25% | Wettable |
| 2 | 0.50% | Wettable |
| 3 | 1% | Not wettable |
| 4 | 2% | Not wettable |

The results of the evaluation demonstrate that a treatment can be applied to the surface of an advancing molten polymer stream prior to exiting a fiber spinning assembly. At treatment levels 4 and 8 times higher than that applied according to the present invention, the internally treated nonwoven web exhibited no degree of wettability. Thus, even at high treatment levels Samples 3 and 4 did not have a sufficient amount of treatment on the surface of the fibers to impart wettability to the nonwoven web.

The method of the present invention offers a significant advantage over current internal treatment systems, since treatments that do not tend to migrate to the surface of the fiber can be used to successfully impart the desired property to the fiber without using very high treatment levels or having to wait for the treatment to migrate to the surface of the fiber over time. Additionally, even when using a highly migratory treatment, a lower treatment level can be used to achieve the same result as would be obtained with a higher treatment level incorporated into the nonwoven web fiber as an internal additive.

Having thus described the invention in detail, it should be apparent that various modifications can be made in the present invention without departing from the spirit and scope of the following claims.

We claim:

1. A method of forming a treated fiber comprising:

a) providing a molten polymer;

b) delivering said molten polymer to a fiber spinning assembly adapted to form and distribute a stream of said molten polymer; and c) applying a treatment in a liquid state to at least one region on the surface of said molten polymer stream within said fiber spinning assembly, such that a substantial portion of said treatment remains on the surface of the resulting fiber within said treated region.

2. The method of claim 1, wherein said treatment has a boiling point of at least about 300° F. (149° C.).

3. The method of claim 1, wherein said treatment is applied at a level of about 0.05% to about 3% by weight of the fiber.

4. The method of claim 1, wherein said treatment is applied at a level of about 0.1% to about 1.5% by weight of the fiber.

5. The method of claim 1, wherein said treatment is applied to the surface of said molten polymer stream at more than one distinct region on the surface of said molten polymer stream.

6. The method of claim 1, wherein more than one treatment is applied to the surface of said molten polymer stream at more than one distinct region on the surface of said molten polymer stream.

7. The method of claim 6, wherein said treatments are miscible.

8. The method of claim 6, wherein said treatments are immiscible.

9. An apparatus for forming a treated fiber comprising:

a) means for providing a molten polymer;

b) means for delivering said molten polymer to a fiber spinning assembly adapted to form and distribute a stream of said molten polymer; and c) means for applying a treatment in a liquid state to at least one region on the surface of said molten polymer stream within said fiber spinning assembly, such that a substantial portion of said treatment remains on the surface of the resulting fiber within said treated region.

* * * * *